US005845865A

United States Patent [19]

Engelhardt

[11] Patent Number: 5,845,865

[45] Date of Patent: Dec. 8, 1998

[54] YARN GUIDE ASSEMBLY FOR LAYING YARN AT A PLURALITY OF WORK STATIONS

[75] Inventor: Dietmar Engelhardt, Moenchengladbach, Germany

[73] Assignee: W. Schlafhorst AG & Co., Moenchengladbach, Germany

[21] Appl. No.: 769,369

[22] Filed: Dec. 18, 1996

Related U.S. Application Data

[63] Continuation-in-part of Ser. No. 527,756, Sep. 13, 1995, abandoned.

[30] Foreign Application Priority Data

Sep. 13, 1994 [DE] Germany ..... 44 32 498.7

[51] Int. Cl.[6] ..... F16C 19/00; B65H 54/28

[52] U.S. Cl. ..... 242/476.7; 242/483.7; 384/58

[58] Field of Search ..... 242/35.5 R, 43 R, 242/157.1, 158 R; 384/50, 52, 53, 58

[56] References Cited

U.S. PATENT DOCUMENTS

| | | | |
|---|---|---|---|
| 2,524,623 | 10/1950 | Columbu | 242/35.5 R X |
| 3,375,045 | 3/1968 | Zeidler | 384/58 |
| 3,998,497 | 12/1976 | Koizumi | 384/53 |
| 4,580,737 | 4/1986 | Schmid | 242/35.5 R |
| 4,867,579 | 9/1989 | Gallone | 384/58 X |
| 4,878,630 | 11/1989 | Schmid | 242/35.5 R X |

FOREIGN PATENT DOCUMENTS

| | | |
|---|---|---|
| 33 45 743 | 8/1989 | Germany . |
| 38 06 691 | 9/1989 | Germany . |
| 44 32 498 | 3/1996 | Germany . |

*Primary Examiner*—Michael Mansen
*Attorney, Agent, or Firm*—Herbert L. Lerner; Laurence A. Greenberg

[57] ABSTRACT

In textile machines that produce cross-wound bobbins, especially open-end spinning machines, the yarn is laid onto the cross-wound bobbins with yarn guides. The yarn guides are commonly reciprocated with a driven traversing rod. All the yarn guides of the work stations located next to one another are driven simultaneously by this traversing rod. For the sake of uniform laying of the yarn and so that the traversing rod will not sag under tensile and compressive strain, careful rectilinear guidance of the traversing rod is required. Four successive support rollers each are angularly distributed about the circumference of the traversing rod in such a way that, viewed in the circumferential direction of the traversing rod, mutually identical wheel flanges are always adjacent to one another. Those support rollers which are adjacent with respect to the circumference of the traversing rod and whose wheel flanges are toward one another each have the same angular spacing relative to the other two support rollers.

8 Claims, 8 Drawing Sheets

YARN GUIDE ASSEMBLY FOR LAYING YARN AT A PLURALITY OF WORK STATIONS

CROSS-REFERENCE TO RELATED APPLICATION

This application is a continuation-in-part of application Ser. No. 08/527,756, filed Sep. 13, 1994, now abandoned.

BACKGROUND OF THE INVENTION

1. Field of the Invention

The invention relates to yarn guides for laying yarn on cross-wound bobbins, or cheeses, at the work stations of a cheese-producing textile machine, whose common drive comprises a traversing rod that is supported, driven to reciprocate, in the machine frame, the traversing rod being guided in such a way, by support rollers disposed at the work stations, that a rectilinear guidance exists.

Yarn guides for laying the yarn on cones that are jointly driven by a traversing rod are used in open-end spinning machines, for instance. The yarn guides of the spinning stations disposed next to one another are driven jointly, simultaneously, by a traversing rod extending along the spinning stations.

2. Description of the Related Art

To assure rectilinear guidance over the long path along the machine and to enable problem-free installation and dismantling, so-called roller guide elements have already been proposed in U.S. Pat. No. 4,580,737 (DE 33 45 743 C2). Those are rollers with a cylindrical outer jacket, which are disposed in so-called element pairs on a base plate. Since each of the base plates are bent at an angle of approximately 120°, the two support rollers disposed one above the other support the traversing rod at an angle of 120°. The securing of the element pairs is done alternatingly from one work station to the next, first with the support rollers oriented toward the spinning station and at the next work station on the opposite side of the traversing rod, remote from the work station. Because of the high number of work stations, a great number of support rollers is needed for supporting and rectilinearly guiding the traversing rod.

SUMMARY OF THE INVENTION

It is accordingly an object of the invention to provide a yarn guide assembly for laying yarn on cones, which overcomes the above-mentioned disadvantages of the heretofore-known devices and methods of this general type and which simplifies the rectilinear guidance and support of the traversing rod while maintaining the good guiding results.

With the foregoing and other objects in view there is provided, in accordance with the invention, a yarn guide assembly for laying yarn on cross-wound bobbins at the work stations of a cross-wound bobbin or cheese-producing textile machine. The yarn guide assembly comprises:

a common drive for a plurality of yarn guides, the common drive including a traversing rod supported in the machine frame, and a drive for reciprocating the traversing rod, the traversing rod having a circumference;

support rollers disposed at the work stations for rectilinearly guiding the traversing rod, a single one of the support rollers being disposed at a respective one of the work stations;

each support roller having a periphery, two ends, and a wheel flange formed at one of the ends on the periphery;

four successively adjacent support rollers each being angularly distributed about the circumference of the traversing rod in such a way that, viewed in the circumferential direction of the traversing rod, identical wheel flanges are disposed adjacent to one another; and two support rollers which are disposed circumferentially adjacent one another and whose wheel flanges face toward one another each having an identical angular spacing relative to the other two of the four support rollers.

In other words, only a single support roller is now provided at each work station, which divides the number of support rollers in half compared with conventional bearings. The wheel flange on one side on the circumference of the support rollers enables exact rectilinear guidance of the traversing rod. The arrangement according to the invention of the four support rollers each in succession prevents twisting of the traversing rod during shogging of the traversing rod from lifting away from one another as a result of moments generated by the wheel flanges, and it assures uniform support if the resultant of the supporting forces passes through the center line of the traversing rod. Moments generated by the individual wheel flanges in the traversing rod are contrary in the circumferential direction, depending on the position of the wheel flange, so that if there is a simultaneous demand for reliable straight-ahead guidance of the traversing rod, the minimum number of support rollers becomes four. It is also possible to dispose a greater number of support rollers about the rod circumference for the purpose of equalization torques and supporting forces, but because of the increased rod length this would cause an increased strain on the traversing rod.

In accordance with an added feature of the invention, the yarn guide assembly includes a support plate which is secured to the machine frame at given attachment points, each the support rollers being disposed on the support plate, and the attachment points for securing the support plates to the machine frame being disposed on mutually opposite sides for facilitating an alternating positioning of the support rollers.

In accordance with an additional feature of the invention, the traversing rod contacts the support rollers with tension.

In accordance with another feature of the invention, the traversing rod has a given rod diameter, a diameter of a circular arc enclosed by lines of contact of successive support rollers and the traversing rod being smaller by not more that 10% as compared to the given rod diameter.

In accordance with a further feature of the invention, the traversing rod has a given rod diameter, a diameter of a circular arc enclosed by lines of contact of successive support rollers and the traversing rod being smaller by not more than 1% to 3% of the given rod diameter.

With the foregoing and other objects in view there is also provided a yarn guide assembly which comprises: a common drive with a traversing rod supported in the machine frame, and a drive for reciprocating the traversing rod, the traversing rod having a circumference; cylindrical support rollers disposed at the work stations for rectilinearly guiding the traversing rod, a single one of the support rollers being disposed at a respective one of the work stations; at least three successive rollers being angularly distributed uniformly over the circumference of the traversing rod.

In accordance with yet another feature of the invention, the support rollers have shafts and the support rollers are each located in one plane; the shafts of the support rollers being perpendicular to a respective the plane; the planes intersecting one another at a center line of the traversing rod;

and tangent lines at contact points between the support rollers and the traversing rod at the circumference of the traversing rod each being oriented perpendicularly to a plane through a respectively contacting support roller.

Calm shogging of the traversing rod is attained if the support rollers contact the traversing rod in such a way that they are under tension. The tension advantageously has the effect that each support roller rests on the traversing rod, is entrained by it and also guides it continuously. This avoids banging and oscillation of the traversing rod and clattering of the support rollers. The tension can by way of example be generated by pressing the support rollers against the traversing rod by means of springs. However, such an embodiment is complicated. It is simpler to press the support rollers without play and tautly against the traversing rod, without clamping them. To that end, when a support plate is installed, for instance, the plate is swiveled about a fastening point such that the diameter of a circular arc enclosed by the lines of contact of the successive support rollers with the traversing rod is smaller than the traversing rod diameter itself. The theoretical reduction in traversing rod diameter by the closing up of the support rollers should be a maximum of 10%. As a rule, a closing up of the support rollers by a few tenths of a millimeter suffices to achieve the desired tension. In this preferred range of the closing up, the theoretical reduction in traversing rod diameter is between 1% and 3%, in terms of an actual traversing rod diameter of about 10 mm. The particular closing up of the support rollers causes a hardly perceptible, non-critical sagging of the traversing rod, which causes the tension in the traversing rod. The support rollers may also be embodied cylindrically, as will be explained below.

Exact rectilinear guidance of the traversing rod with one support roller per work station is attained when at least three cylindrical rollers are each distributed successively and uniformly over the circumference of the traversing rod.

The axes of rotation of the support rollers are each in a plane located at right angles to the center axis of the traversing rod. By this provision as well, still-adequate rectilinear guidance of the traversing rod is attained. The bearing of the support rollers is made more economical and simple as a result.

Other features which are considered as characteristic for the invention are set forth in the appended claims.

Although the invention is illustrated and described herein as embodied in a yarn guide assembly for laying yarn on cones, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
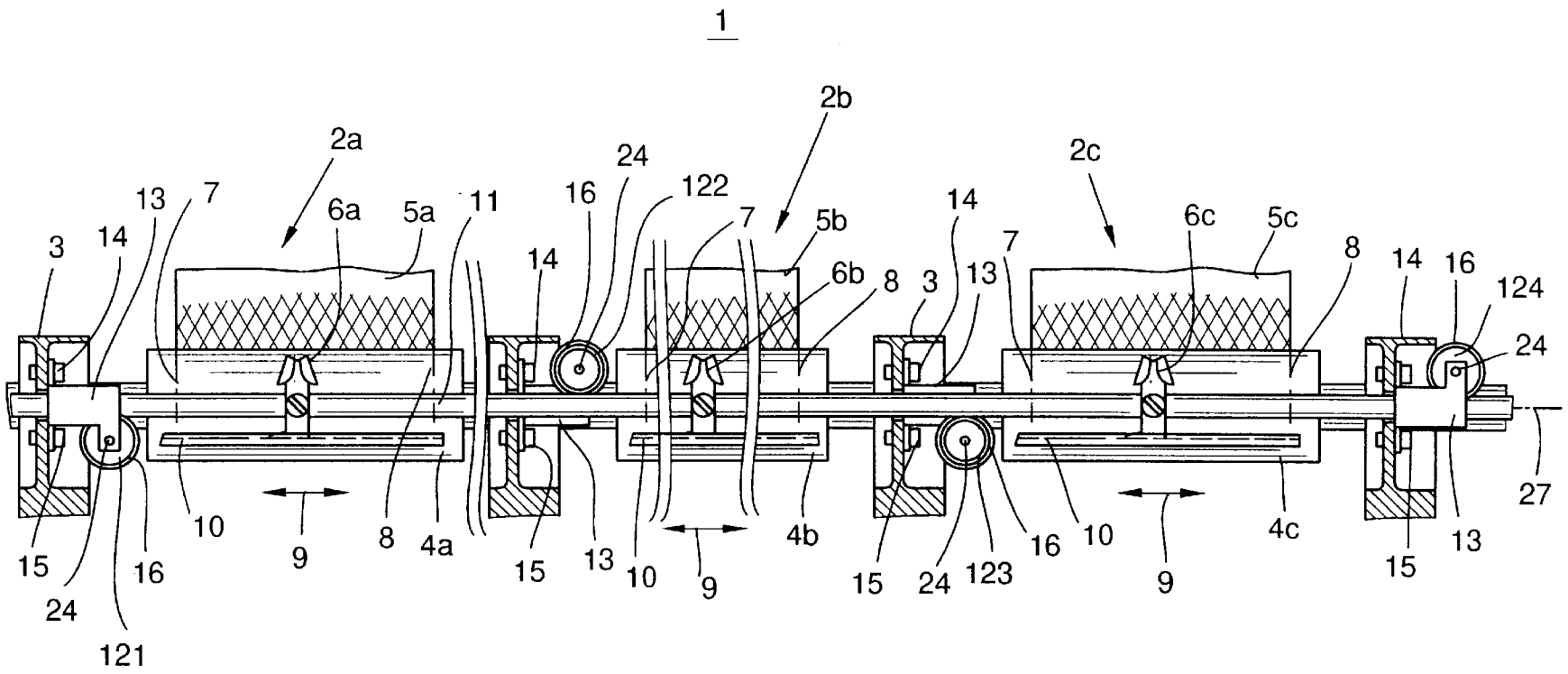
FIG. 1 is a fragmentary, diagrammatic, side elevational view of three mutually adjacent winding stations in a textile machine with the traversing rod bearing according to the invention.

Referring now to the figures of the drawing in detail and first, particularly, to FIG. 1 thereof, there are seen three work stations 2*a,* 2*b* and 2*c,* which are three winding stations for winding cross-wound bobbins or cones. The three winding stations form a part of a textile machine 1 that produces cones. Only those characteristics that contribute to understanding of the invention are shown and described.

In the machine frame 3, which is the side walls of the work stations, the drive mechanism and bearing of the winding rollers 4*a,* 4*b* and 4*c* are accommodated, although not shown here. The cones 5*a,* 5*b* and 5*c* each rest with their circumferential face on the respective winding roller 4*a,* 4*b,* 4*c* driving them.

A yarn guide 6*a,* 6*b* and 6*c* moves in front of each cone 2*a*–2*c* for laying the yarn in cross-wound layers within the shogging region defined by the shogging boundaries 7 and 8. To prevent the yarn guides from tilting during their reciprocating motion, represented by the double-headed arrow 9, in the present exemplary embodiment they are guided in a grooved rail 10 that extends along the work stations.

Each of the yarn guides 6*a,* 6*b* and 6*c* is secured to a traversing rod 11, which extends along all the work stations of the textile machine. The reciprocating drive of the traversing rod 11, likewise represented by the double-headed arrow 9, is produced by a device not shown here but known from the prior art. The bearing of the traversing rod 11 is accomplished in accordance with the invention at each work station, of which the work stations 2*a,* 2*b* and 2*c* are shown here, by means of one support roller. Each of the four support rollers 121, 122, 123, and 124 visible here is supported on a support plate 13. Each of the support plates 13 is secured to the machine frame 3 at the respective securing points 14 and 15. Each support roller has a wheel flange 16. The support rollers are disposed such that that they rest, distributed over the circumference of the traversing rod 11, with their wheel flanges 16 on the traversing rod. The disposition of the support rollers will be described in further detail in conjunction with FIG. 3.

In FIG. 1, the support roller 121 in the work station 2*a* is disposed such that the support plate 13 is toward the observer. For the observer of FIG. 1, the shafts 24 of the support rollers are each located alternatingly above and below the center line 27 of the traversing rod 11. In the case of the support rollers 121 and 123, whose shafts 24 are located below the center line 27 of the traversing rod 11, the support rollers have their wheel flanges alternatingly facing one another. The same is true for the support rollers 122 and 124, whose shafts 24 are located above the center line 27 at the traversing rod 11. After the support roller 124, the ensuing support rollers follow in an arrangement that begins with a support roller in a position that corresponds to that of the support roller 121. This cycle of disposition continues in the same way along the entire machine.

Figure 2:
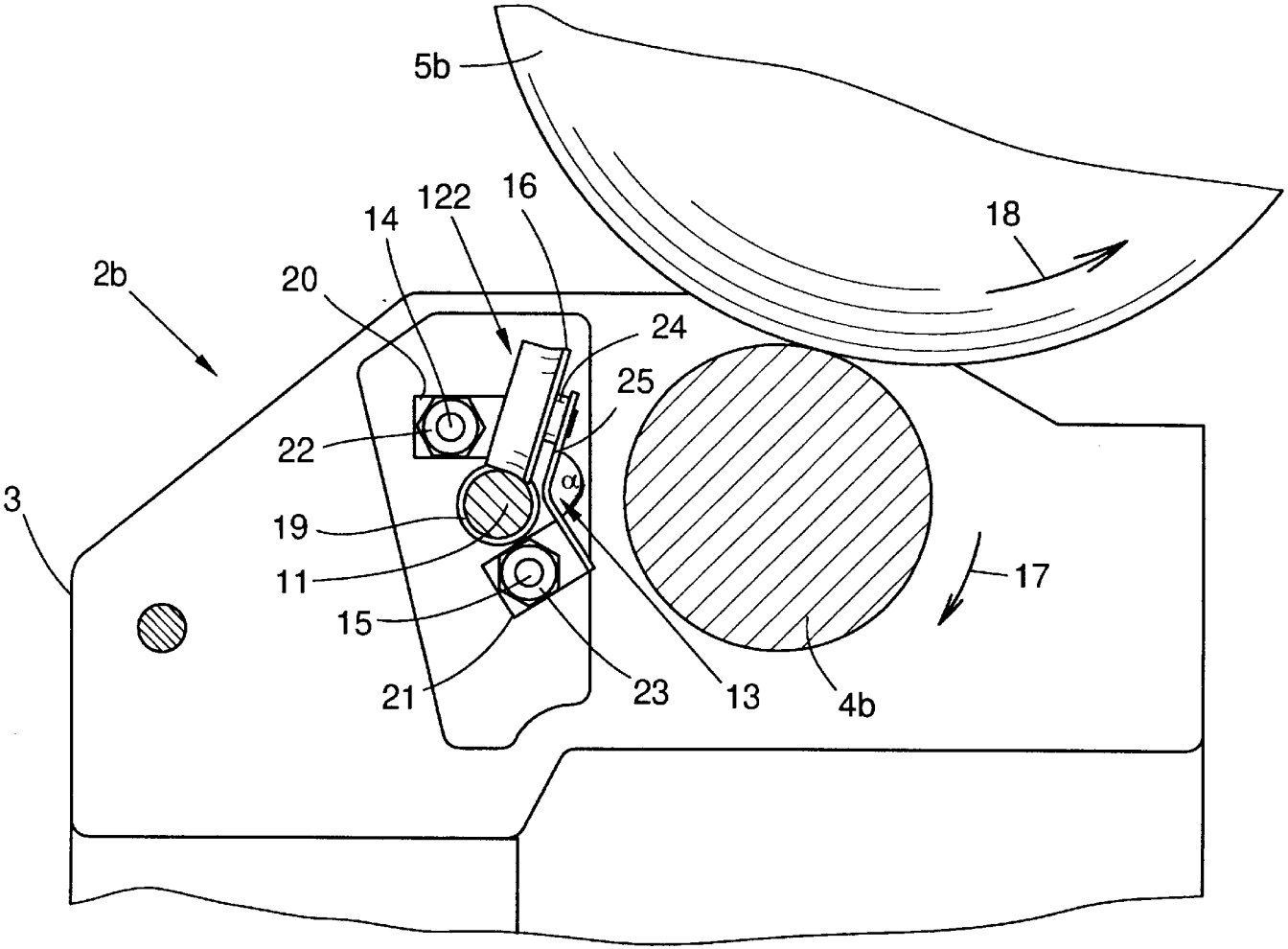
FIG. 2 is an enlarged, fragmentary, front elevational view of a machine frame at a work station, with a bearing point of the traversing rod.

FIG. 2 shows the bearing of the traversing rod at the work station 2*b*. A portion of the machine frame for work station 2*b* is shown. During winding, the cone 5*b* is driven by the winding roller 4*b*. While the winding roller rotates in the direction of the arrow 17, the cone 5*b* supported on it is driven in the direction of the arrow 18. The traversing rod 11, on which the yarn guide 6*b*, not shown here, is disposed for laying the yarn on the cone 5*b*, is guided through an opening 19 on the machine frame 3. At the securing points 14 and 15, the support plate 13 is secured to a support roller 122. The support plate 13 is disposed behind the traversing rod 11, if the observer is looking toward the work station 2*b*, and the support roller 122 guides the traversing rod 11 in the upper region. The support roller 122 is disposed such that the wheel flange 16 is toward the work station.

As can be seen from FIG. 2, the support plate 13 is secured to the machine frame 3 by two bent tabs 20 and 21. The support plate 13 itself is bent at an angle $\alpha$ of 120°. The tabs 20 and 21 are of different lengths and have hexagonal nuts 22 and 23, welded to the tabs 20 and 21, for securing them to the securing points 14 and 15. The shaft 24 of the support roller 122 is perpendicular to the support plate 13. The support plate 13, with the tabs 20 and 21 and the respective support roller disposed on it, forms a structural unit.

Figure 3:
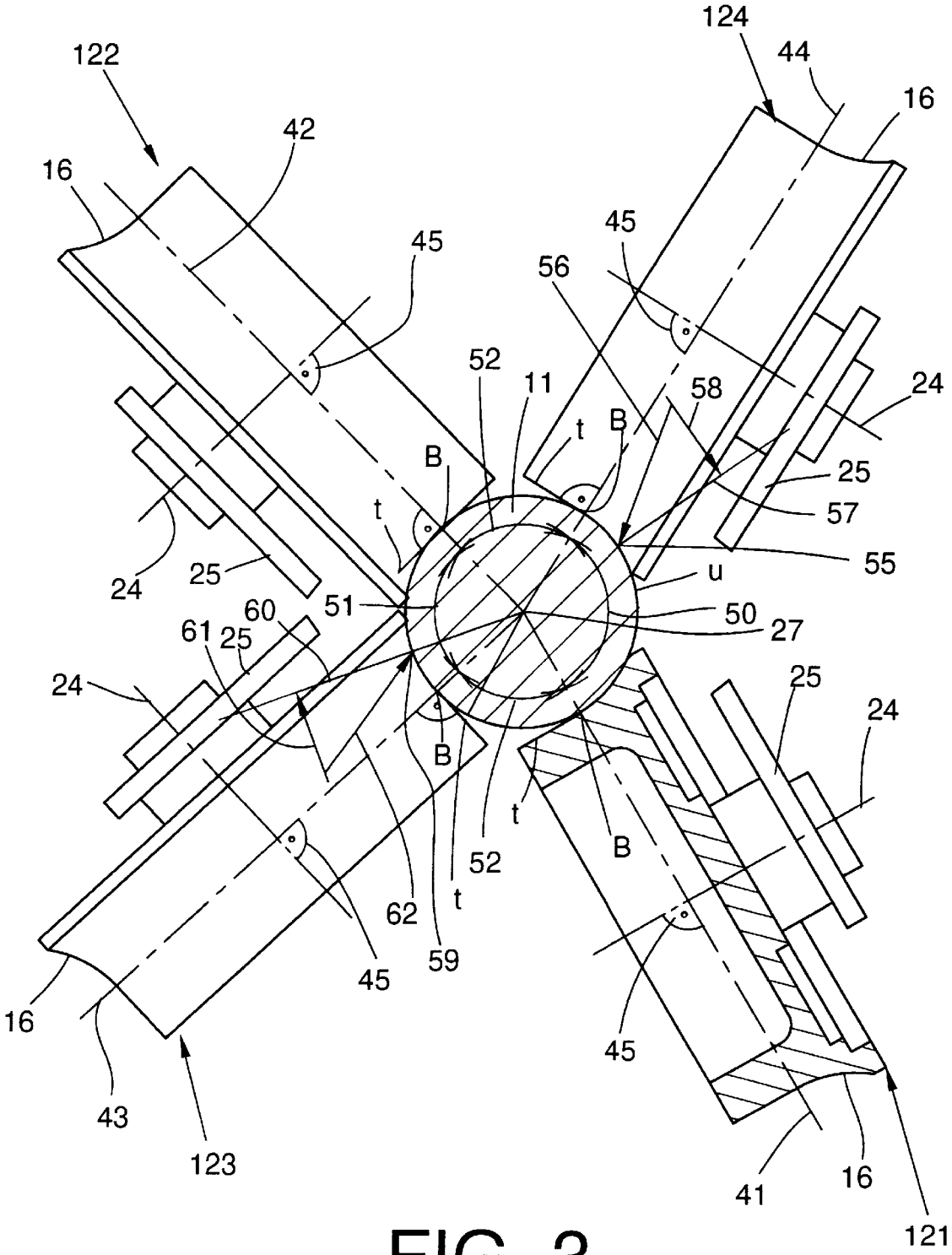
FIG. 3 is a diagrammatic frontal view of four successively adjacent support rollers in their angular distribution about the circumference of the traversing rod.

In FIG. 3, one of the possible arrangements of support rollers along the traversing rod at the various work stations is shown. These are the four support rollers 121–124 of FIG. 1. For greater clarity of illustration, the machine frames and the bobbin winders have been omitted from the drawing. The shafts 24 of the support rollers are each perpendicular to a plane that passes through the support roller and the center line 27 of the traversing rod 11, as the angle 45 indicates. As the contact point B of the traversing rod 11 and support roller, through which point the plane passes, the tangent t to the circumference u of the traversing rod 11 is perpendicular to the plane. The support rollers 121 and 124 that to the observer of FIG. 1 are located in front of the traversing rod 11, as well as all the ensuing support rollers, are at the same angular spacing from one another in the present exemplary embodiment, at an angle 50 of 120°.

The support rollers are disposed such that the wheel flanges 16 are toward one another. The support rollers 122 and 123 that to the observer of FIG. 1 are located behind the traversing rod 11 and all the following support rollers are likewise at the same angular spacing in the present exemplary embodiment, at an angle 51 of 90°, from one another.

Once again, the support rollers are arranged such that the wheel flanges 16 are toward one another. The support rollers 121 and 124 of the support roller arrangement located in front of the traversing rod 11 are spaced apart from the support rollers 122 and 123 of the support roller arrangement located behind the traversing rod 11 at the same angle 52 from one another in the present exemplary embodiment. It is also conceivable that the angle may be different between the support rollers 121 and 123 and ensuing support rollers, on the one hand, and 122 and 124 and the ensuing support rollers, on the other.

Because the mutually opposed support rollers 121 and 122, and 123 and 124, rest on the traversing rod 11 with their wheel flanges 16 on opposite sides, an exact rectilinear guidance of the traversing rod 11 is attained. If the supporting force exerted by the support rollers on the traversing rod does not act in the respective planes 41–44 through the center line 27 of the traversing rod 11, the result is moments that act upon the traversing rod. Such moments occur particularly whenever the traversing rod is supported on the support rollers in the region of the wheel flanges. For instance, if shifting of the traversing rod occurs, such that it is supported on the support roller 124 at the point 55, and if a supporting force 56 acts upon the traversing rod 11 at that point, then this can be broken down into one component 57 perpendicular to the center line 27 and one component 58 tangent to the traversing rod 11. The component 58 tangent to the traversing rod seeks to exert a torque on the traversing rod. As a rule, the shifting of the traversing rod on one roller will lead to a shifting on the opposite roller, in the present case the roller 123. The force 60 acting there at the point 59 again be broken down into one component 61 tangent to the traversing rod 11 and a second component 62 perpendicular to the center line 27. The force 61 seeks to exert a torque on the traversing rod that is counter to the torque effected by the force 58. The moments are not of equal magnitude, but because of the shifting relative to the other support rollers, the total moments acting on the circumference of the traversing rod will cancel one another out over the length of the rod.

The distribution of support rollers shown in FIG. 3, especially because of the disposition of the support rollers 122 and 123 located behind the traversing rod 11, can intercept the forces exerted by the yarn tension on the yarn guide and thus exerted on the traversing rod and can avert sagging acting preferentially in the direction of the aforementioned rollers.

Figure 4A:
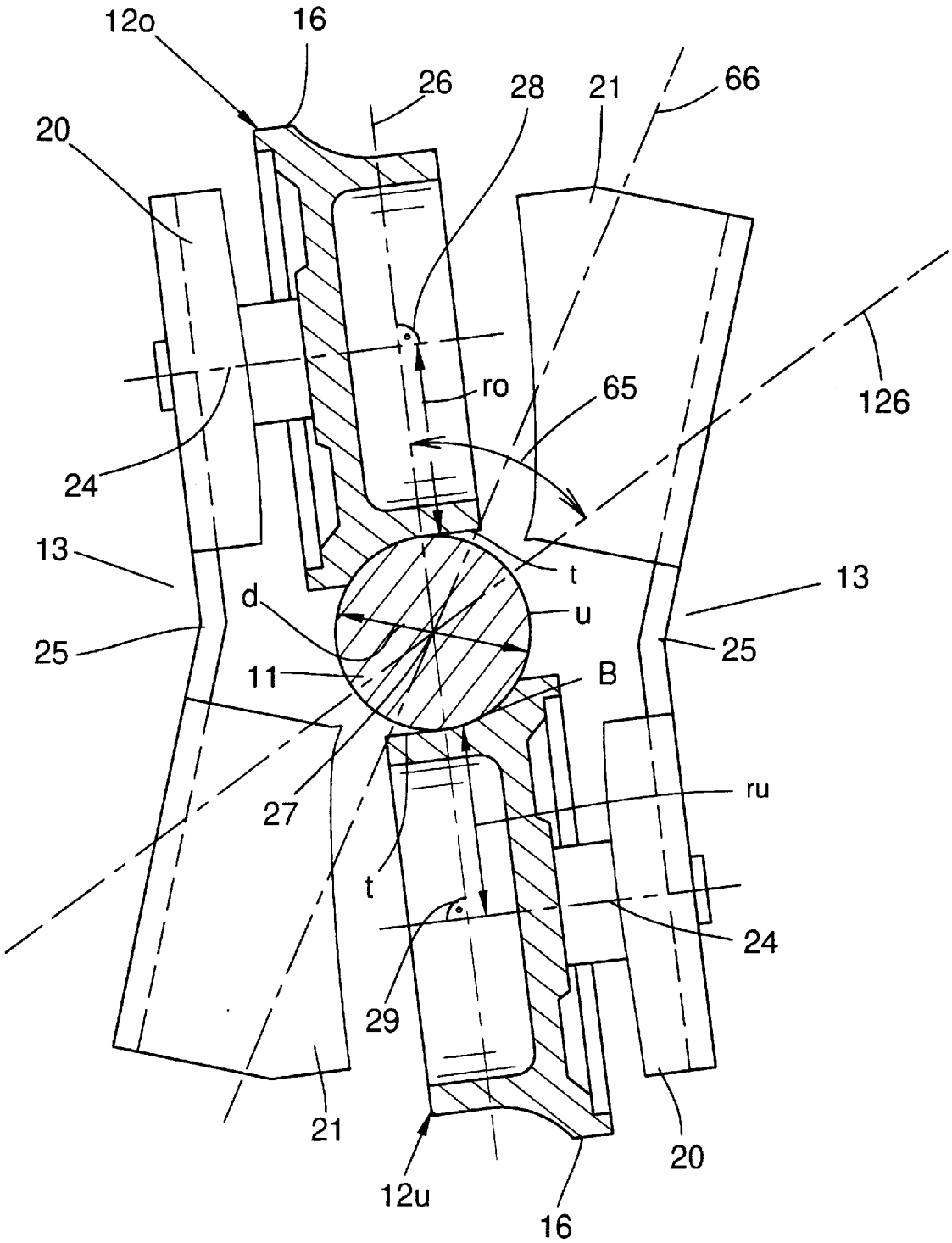
FIGS. 4*a* is a similar view of two successive support rollers which rest alternatingly opposite one another (and longitudinally offset) on the traversing rod.
Figure 4B:
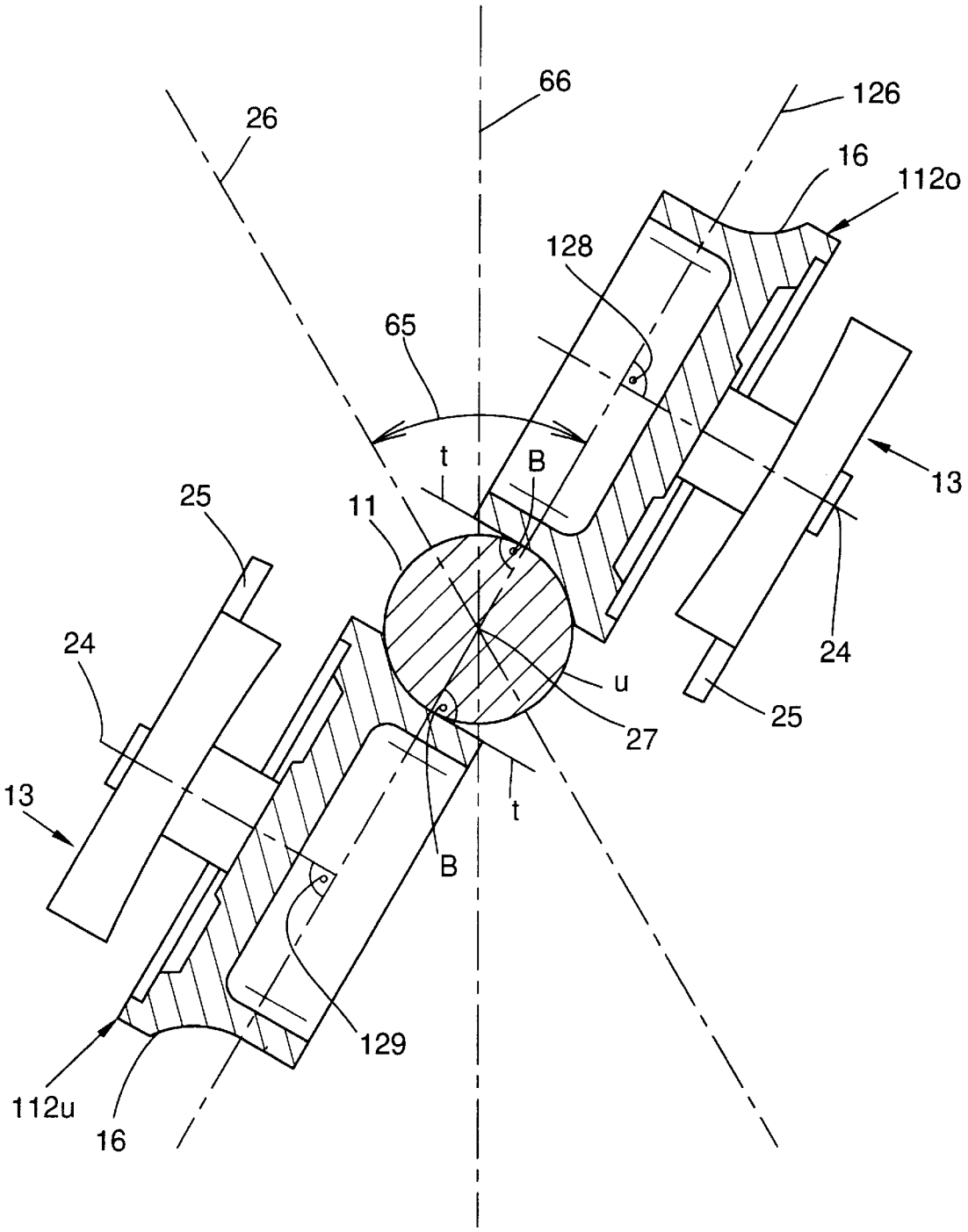
FIG. 4*b* is a similar a view of two mutually adjacent support rollers which follow the support rollers of FIG. 4*a;*

In FIGS. 4*a* and 4*b*, a special arrangement of the support rollers on the circumference of the traversing rod 11 is shown. The mutually adjacent support rollers 12*o* and 12*u* as well as 112*o* and 112*u* are located directly opposite one another in a plane 26. They rest on the traversing rod 11 in such a way that their respective wheel flanges 16 face one another. This arrangement of the support rollers is comparable to the arrangement of the support rollers 121 and 122 in FIG. 1. The two support rollers 112*o* and 112*u* that follow them are likewise facing one another in a plane 126, as can be seen from FIG. 4*b*. Once again, the wheel flanges 16 rest from opposite sides on the traversing rod 11, and the shafts 24 are perpendicular to the plane 126, as can be seen from the angles 128 and 129. This arrangement of the support rollers is comparable to the arrangement of the support rollers 123 and 124 in FIG. 1.

The two planes 26 and 126 enclose an angle 65, which in this case is 60° but may also be expanded to 90°. In the present exemplary embodiment, the sequential arrangement of the support rollers is equivalent in each case to a folding mirroring at the angle bisector 66 of the angle 65 between the two planes 26 and 126.

If the support plate 13 known from FIG. 2 is rotated by 180°, so that the tab 21 at the securing point 14 and the tab 20 at the securing point 15 is rotated, then the support roller located at the top is rotated by 180° about the traversing rod 11. The support roller then rests with its wheel flange on the traversing rod 11 in the opposite direction from that of the upper support roller.

FIG. 4*a* is a view of two support rollers disposed one after the other on the traversing rod 11. The machine frame 3 has not been shown here. As to how the support rollers 12*o* and

12*u* disposed one above the other look, in reality the support of the traversing rod is spaced apart by the width of one work station. The center line 27 of the traversing rod 11 is located in a plane 26, and the tangents t to the circumference of the traversing rod 11 at the respective contact point B of the traversing rod 11 and the support roller 12*o* and 12*u*, respectively, are perpendicular to the plane 26.

If as in the present exemplary embodiment shown in FIG. 4*a* the shafts 24 of the support rollers 12*o* and 12*u* are perpendicular to the plane 26, as represented by the right angles 28 and 29, then optimal guidance of the traversing rod 11 is accomplished by the circumferential faces of the support rollers with their respective wheel flanges 16.

To attain calm shogging of the traversing rod 11, the traversing rod is put under tension by the support rollers 12*o* and 12*u*. To that end, for instance when the support plates 13 of the support rollers 12*o* and 12*u* are installed, the support plates are each pivoted slightly about their respective fastening point 15 and 14, making the spacing between two adjacent support rollers 12*o* and 12*u* less, by a few tenths of a millimeter, than the sum of the radii ro and ru of the two support rollers 12*o* and 12*u* and the diameter d of the traversing rod 11.

Figure 5:
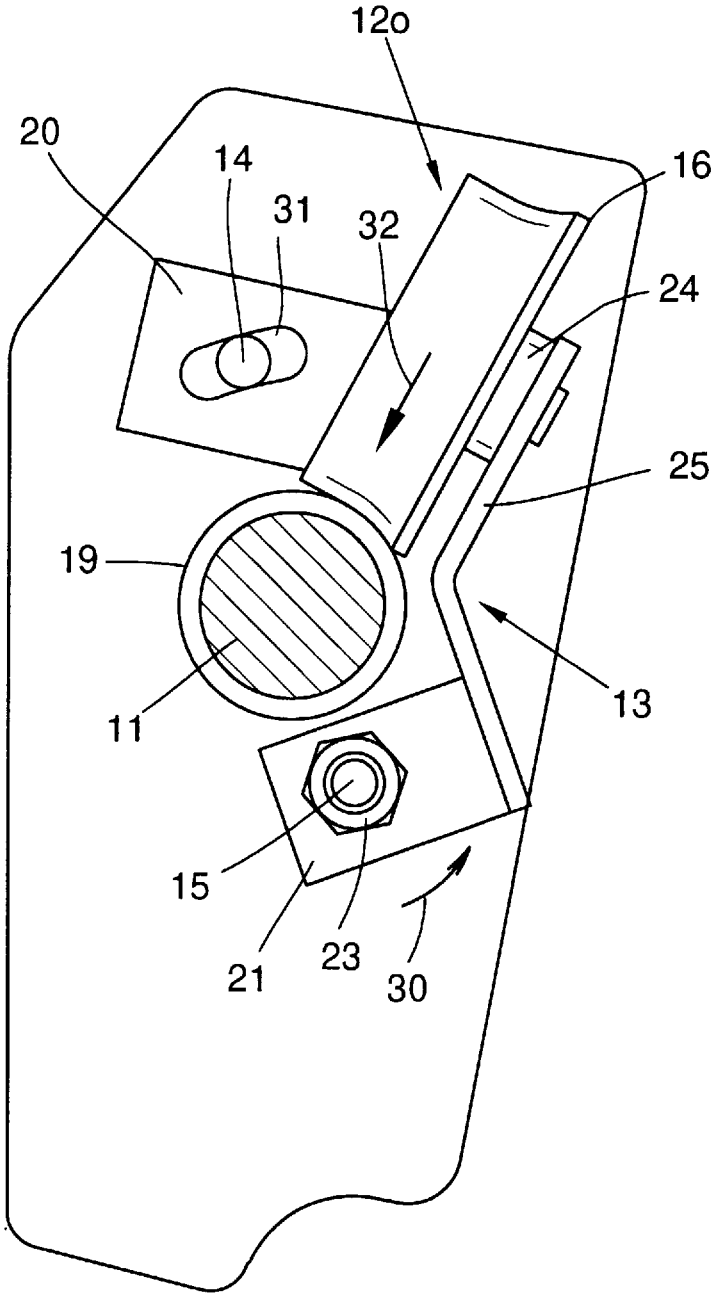
FIG. 5 is a partly sectional, front elevational view of one structural option for guiding the traversing rod with tension by means of the support rollers.

FIG. 5 shows an example for a support plate that can be pivotally mounted about a securing point so as to guide the traversing rod with tension by means of the support roller. The support plate 13 for an upper support roller 12*o* is pivotable about the securing point 15, as indicated by the arrow 30. The pivoting is made possible by an oblong slot 31 in the tab 20, which allows a change of position relative to the securing point 14. Pivoting the support plate 3 in the direction of the arrow 30 presses the support roller 12*o* against the traversing rod 11 in the direction of the arrow 32. This causes a hardly perceptible sagging, which brings about the tension in the traversing rod.

Figure 6:
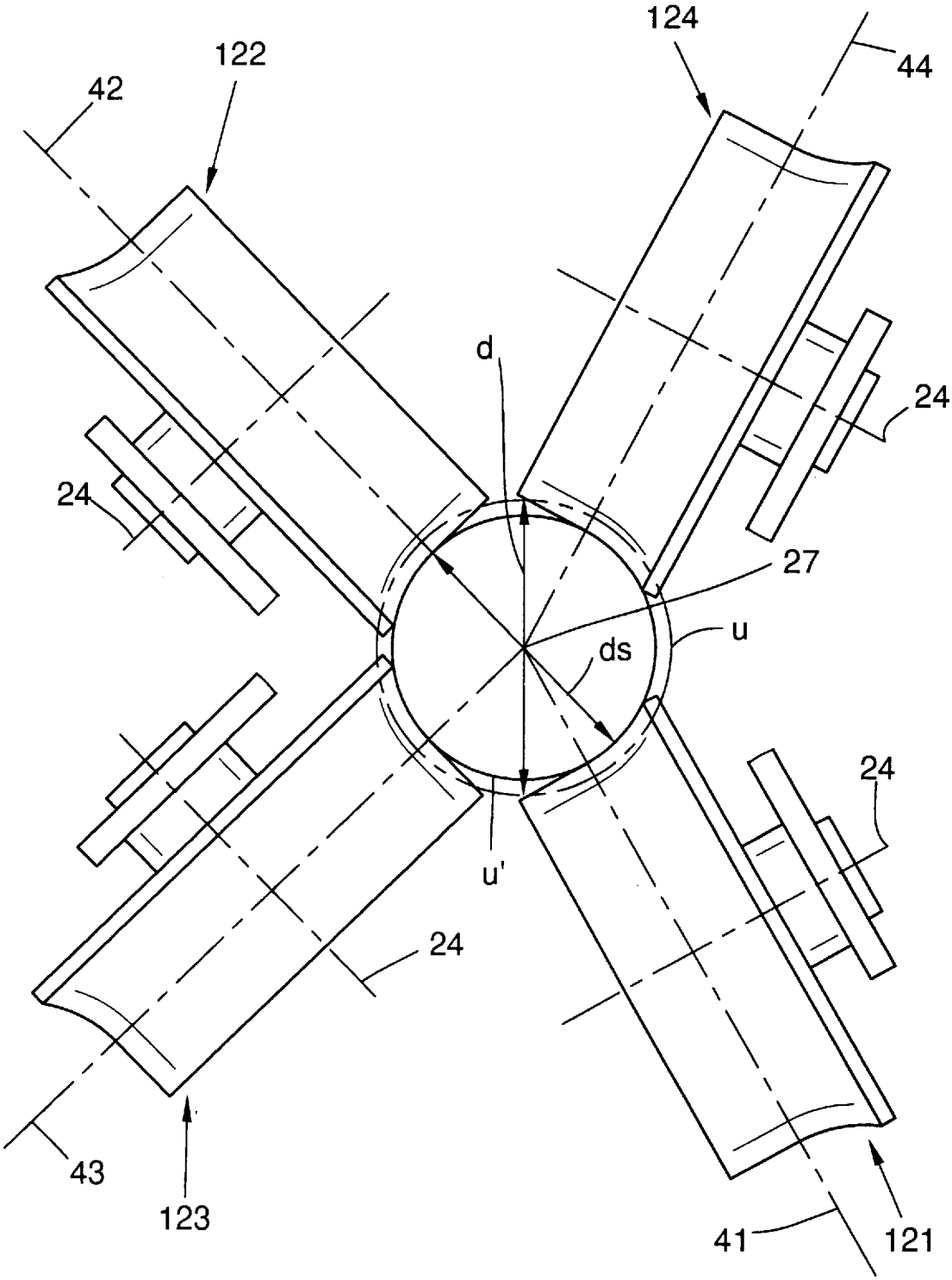
FIG. 6 is a view similar to FIG. 4 showing the disposition of support rollers which guide the traversing rod without play and tautly.

An arrangement of support rollers and traversing rod to one another in such a way that the traversing rod is guided with tension is shown in FIG. 6. For the sake of simplicity, of the traversing rod 11 shown in section, only the circumferential profile u is shown, in dashed lines. From the contours of the support rollers 121, 122, 123 and 124, as arranged in accordance with FIG. 3, it can be seen that the diameter of a circular arc u' enclosed by the contact lines, formed by the wheel flange contour, of the successive support rollers and the traversing rod 11 is smaller than the traversing rod diameter ds itself. The decrease in diameter is 10% at maximum and as a rule is between 1% and 3%, referred to an actual traversing rod diameter of about 10 mm.

Figure 7:
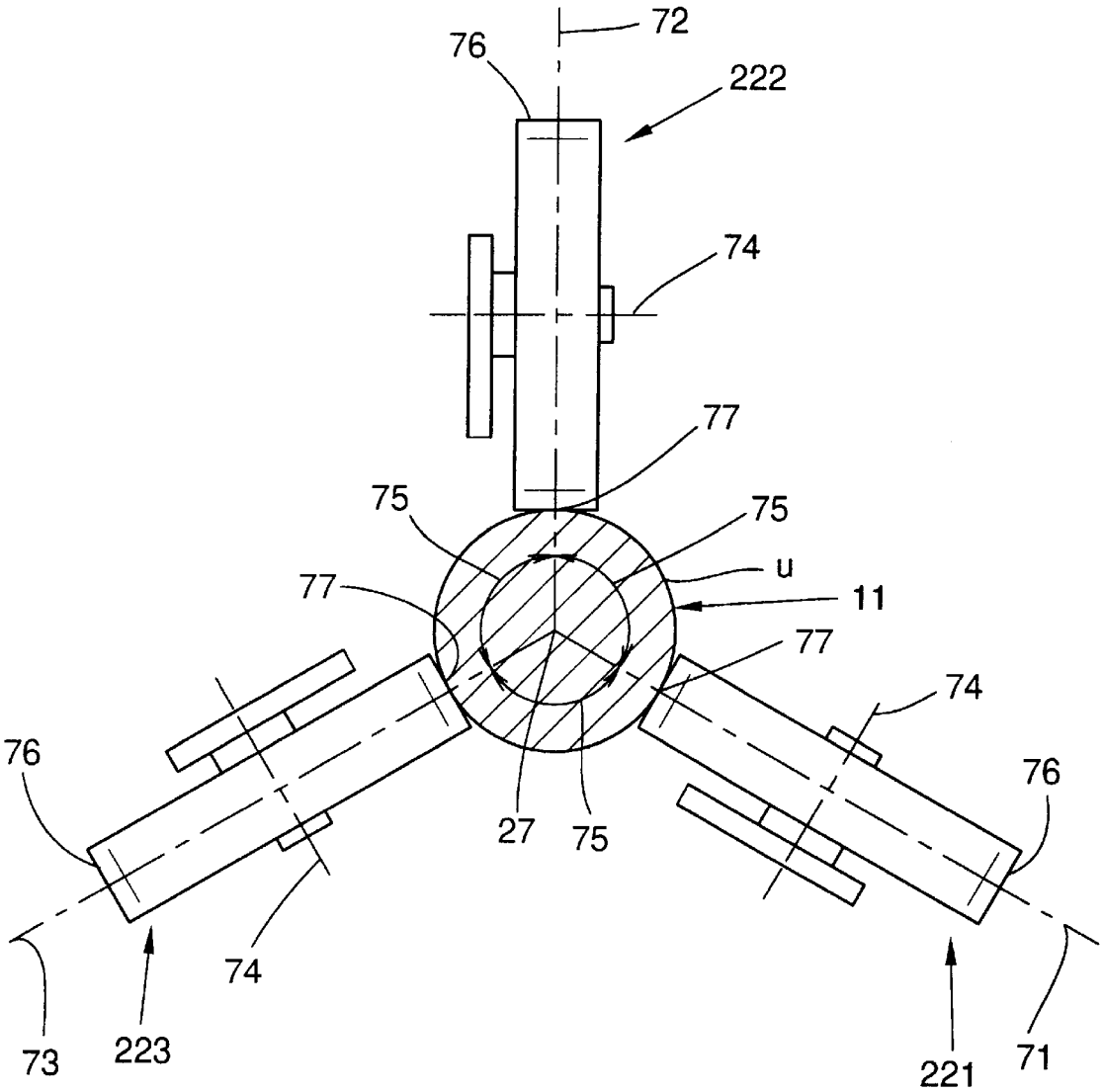
FIG. 7 is a diagrammatic front elevational view showing three cylindrical support rollers distributed about the circumference of the traversing rod.

FIG. 7 schematically shows an embodiment of the invention in which three cylindrical support rollers 221, 222 and 223 are disposed one after the other, distributed uniformly over the circumference of the traversing rod 11. The center line 27 of the traversing rod 11 passes through the intersection of the planes 71, 72 and 73 in which the support rollers 221, 222 and 223, respectively, are located and to which planes the axes 74 of these support rollers are respectively perpendicular. The angles 75 between the planes 71, 72 and 73 are equal, in the present exemplary embodiment, and thus are 120 each. Because of their cylindrical circumferential faces 76, the support rollers 221, 222 and 223, in the ideal case, rest only pointwise at the points 77 on the circumferential face u of the traversing rod 11, at which points the respective planes 71, 72 and 73 intersect the traversing rod 11. By this type and arrangement of support rollers as well, rectilinear guidance of the traversing rod is attained.

The helical succession of the arrangement of support rollers can either be repeated continuously or be rotated after a sequence of three support rollers each, for instance by 180° each time. An arrangement of four support rollers, for instance as in the preceding exemplary embodiments, would also be conceivable.

I claim:

1. In a cross-wound bobbin or cheese-producing textile machine having a machine frame and work stations, a yarn guide assembly with a yarn guide at each of the work stations for laying yarn on cross-wound bobbins at the work stations, comprising:

a common drive for a plurality of yarn guides, said common drive including a traversing rod supported in the machine frame, and a drive for reciprocating said traversing rod, said traversing rod having a circumference;

a plurality of support rollers each disposed at a respective one of the work stations for rectilinearly guiding said traversing rod;

each of said support rollers having a periphery, two ends, and a wheel flange formed at one of said ends on said periphery;

four successively adjacent ones of said support rollers each being angularly distributed about the circumference of said traversing rod in such a way that, viewed in the circumferential direction of the traversing rod, identical wheel flanges are disposed adjacent to one another; and two of said four support rollers which are disposed circumferentially adjacent one another and whose wheel flanges face toward one another each having an identical angular spacing relative to the other two of said four support rollers.

2. The yarn guide assembly according to claim 1, including a support plate carrying each of said rollers, said support plate being secured to the machine frame at given attachment points said attachment points being disposed on mutually opposite sides relative to said traversing rod for facilitating positioning of mutually adjacent ones of said support rollers relative to said traversing rod.

3. The yarn guide assembly according to claim 1, wherein said support rollers are disposed so as to clamp said traversing rod between said support rollers and so that said traversing rod contacts said support rollers with tension.

4. The yarn guide assembly according to claim 3, wherein said traversing rod has a given rod diameter, a diameter of a circular arc enclosed by lines of contact of mutually adjacent said support rollers and said traversing rod being smaller by not more that 10% as compared to said given rod diameter.

5. The yarn guide assembly according to claim 3, wherein said traversing rod has a given rod diameter, a diameter of a circular arc enclosed by lines of contact of mutually adjacent said support rollers and said traversing rod being smaller by between 1% and 3% as compared to said given rod diameter.

6. The yarn guide assembly according to claim 1, wherein said traversing rod has a center line, said support rollers have shafts and said support rollers are each located in one plane;

said shafts of said support rollers being perpendicular to a respective said plane;

said planes intersecting one another at the center line of the traversing rod; and tangent lines at contact points between said support rollers and said traversing rod at said circumference of said traversing rod each being oriented perpendicularly to a plane through a respectively contacting said support roller.

7. In a cross-wound bobbin or cheese-producing textile machine having a machine frame and a plurality of work stations, a yarn guide assembly with yarn guides at each of the work stations for laying yarn on cross-wound bobbins at the work stations, comprising:

a common drive for a plurality of yarn guides, said common drive including a traversing rod supported in the machine frame, and a drive for reciprocating said traversing rod, said traversing rod having a circumference;

a plurality of cylindrical support rollers each disposed at a respective one of the work stations for rectilinearly guiding said traversing rod;

at least three adjacent ones of said rollers being angularly distributed uniformly over the circumference of said traversing rod.

8. The yarn guide assembly according to claim 7, wherein said traversing rod has a center line, said support rollers have shafts and said support rollers are each located in one plane;

said shafts of said support rollers being perpendicular to a respective said plane;

said planes intersecting one another at the center line of the traversing rod; and tangent lines at contact points between said support rollers and said traversing rod at said circumference of said traversing rod each being oriented perpendicularly to a plane through a respectively contacting said support roller.

* * * * *